US008917220B2

(12) United States Patent
Ziolkowski et al.

(10) Patent No.: US 8,917,220 B2
(45) Date of Patent: Dec. 23, 2014

(54) MULTI-BAND, BROADBAND, HIGH ANGLE SANDWICH RADOME STRUCTURE

(75) Inventors: Fredric Paul Ziolkowski, South Grafton, MA (US); Thomas John Clark, Leominster, MA (US)

(73) Assignee: CPI Radant Technologies, Division Inc., Stow, MA (US)

( * ) Notice: Subject to any disclaimer, the term of this patent is extended or adjusted under 35 U.S.C. 154(b) by 627 days.

(21) Appl. No.: 13/135,263

(22) Filed: Jun. 30, 2011

(65) Prior Publication Data

US 2013/0002514 A1 Jan. 3, 2013

(51) Int. Cl.
*H01Q 1/42* (2006.01)

(52) U.S. Cl.
USPC ..... 343/872; 343/873

(58) Field of Classification Search
USPC ..... 343/872, 873, 910, 911 R
See application file for complete search history.

(56) References Cited

U.S. PATENT DOCUMENTS

| | | | | |
|---|---|---|---|---|
| 7,420,523 | B1 | 9/2008 | Ziolkowski et al. | |
| 8,081,137 | B2 * | 12/2011 | Chang et al. | 343/872 |
| 2006/0036012 | A1 * | 2/2006 | Hayes et al. | 524/445 |

* cited by examiner

*Primary Examiner* — Karl D Frech
(74) *Attorney, Agent, or Firm* — Iandiorio Teska & Coleman, LLP

(57) ABSTRACT

A multi-band, broadband, high angle, sandwich radome structure including a structural layer; a first inside matching layer adjacent to one side of the structural layer; an outside matching layer adjacent to the other side of the structural layer; and a second inside matching layer for increasing broadband microwave and millimeter wave frequency transparency.

27 Claims, 3 Drawing Sheets

MULTI-BAND, BROADBAND, HIGH ANGLE SANDWICH RADOME STRUCTURE

FIELD OF THE INVENTION

This invention relates to a multi-band, broadband, high angle sandwich radome structure.

BACKGROUND OF THE INVENTION

Military and commercial communication links are anticipating expansion to joint operation at Ku-band (approximately 11 to 15 GHz) and millimeter wave frequencies (approximately 20 and 30 GHz). Military links are also anticipating 20, 30, and 45 GHz. The flattened, streamlined shapes of the radomes required for these links imposes high incidence angles in the forward and aft directions at low elevation angles. The combination of the high incidence angles, the millimeter wave frequencies, and the multi-band operation exceeds the capabilities of conventional radomes. The conventional sandwich wall that functions acceptably, either for X-band or for Ku-band only, becomes inadequate for multi-band, and broadband high angle designs that must also function at millimeter wave frequencies. For example, U.S. Pat. No. 7,420,523 B1 discloses a three layer structure (exclusive of electrically thin coatings or films). Although suitable for broadband and for two band performance for high incidence angles, its performance is not adequate for the emerging high angle, three band requirements.

SUMMARY OF THE INVENTION

It is therefore an object of this invention to provide an improved sandwich radome structure.

It is a further object of this invention to provide such an improved sandwich radome structure which is capable of multi-band and broadband operation.

It is a further object of this invention to provide such an improved sandwich radome structure which is capable of high incidence transmission.

It is a further object of this invention to provide such an improved sandwich radome structure which has sufficient strength.

It is a further object of this invention to provide such an improved sandwich radome structure which provides a unique combination of multi-band, broadband transmission performance with wall thickness and composition sufficient for necessary strength and stiffness.

The invention results from the realization that a truly improved, multi-band, broadband, high angle sandwich radome structure can be achieved with a structural layer; an inside matching layer adjacent to one side of the structural layer; an outside matching layer adjacent to the other side of the structural layer; and an inner transmission enhancing layer for increasing broadband microwave and millimeter wave frequency transparency.

The subject invention, however, in other embodiments, need not achieve all these objectives and the claims hereof should not be limited to structures or methods capable of achieving these objectives.

This invention features a multi-band, broadband, high angle, sandwich radome structure comprising, a structural layer, a first inside matching layer adjacent to one side of the structural layer, an outside matching layer adjacent to the other side of the structural layer, and a second inside matching layer for increasing broadband microwave and millimeter wave frequency transparency.

In a preferred embodiment the second inside matching layer may include a low density medium. The low density medium may include an aerogel material. The low density material may include a polymer foam. The low density material may include an E-Glass or a quartz fiber matting. The low density medium may include a honeycomb material. The structural layer may be a laminate. The structural layer may include at least one of epoxy and cyanate ester resin combined with a reinforcing fabric. The reinforcing fabric may be at least one of low relative permittivity quartz fabric, high permittivity E-glass fabric, and high modulus polypropylene (HMPP). The structural layer may have a density of 60-120 pounds per cubic foot. The structural layer may have a permittivity of 2.5-4.5. The first inside and the outside matching layers may include a syntactic film. The syntactic film may have a density of 30-45 pounds per cubic foot. The syntactic film may have a permittivity of 1.6 to 2.2. The second inside matching layer may have a density of approximately eight pounds per cubic foot. The second inside matching layer may have a permittivity between 1.05 and 1.25 inclusive, This invention also features a multi-band, broadband, high angle, sandwich radome structure comprising, a laminate structural layer, a first inside matching syntactic layer adjacent to one side of the structural layer, an outside matching layer adjacent to the other side of the structural layer, and a second inside matching layer for increasing broadband microwave and millimeter wave transparency.

In a preferred embodiment the second inside matching layer may include a foam material. The foam material may include a polymer foam. The second inside matching layer may include an aerogel material. The second inside matching layer may include an E-Glass or a quartz fiber matting. The second inside matching layer may include a honeycomb material.

This invention also features a multi-band, broadband, high angle, sandwich radome structure comprising, a laminate structural layer, a first inside matching syntactic layer is adjacent to one side of the structural layer, an outside matching syntactic layer adjacent to the other side of the structural layer, and a second inside matching aerogel layer for increasing broadband and microwave and millimeter wave frequency transparency.

In a preferred embodiment the second inside matching layer may include a foam material. The foam material may include a polymer foam. The second inside matching layer may include an aerogel material. The second inside matching layer may include an E-Glass or a quartz fiber matting.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
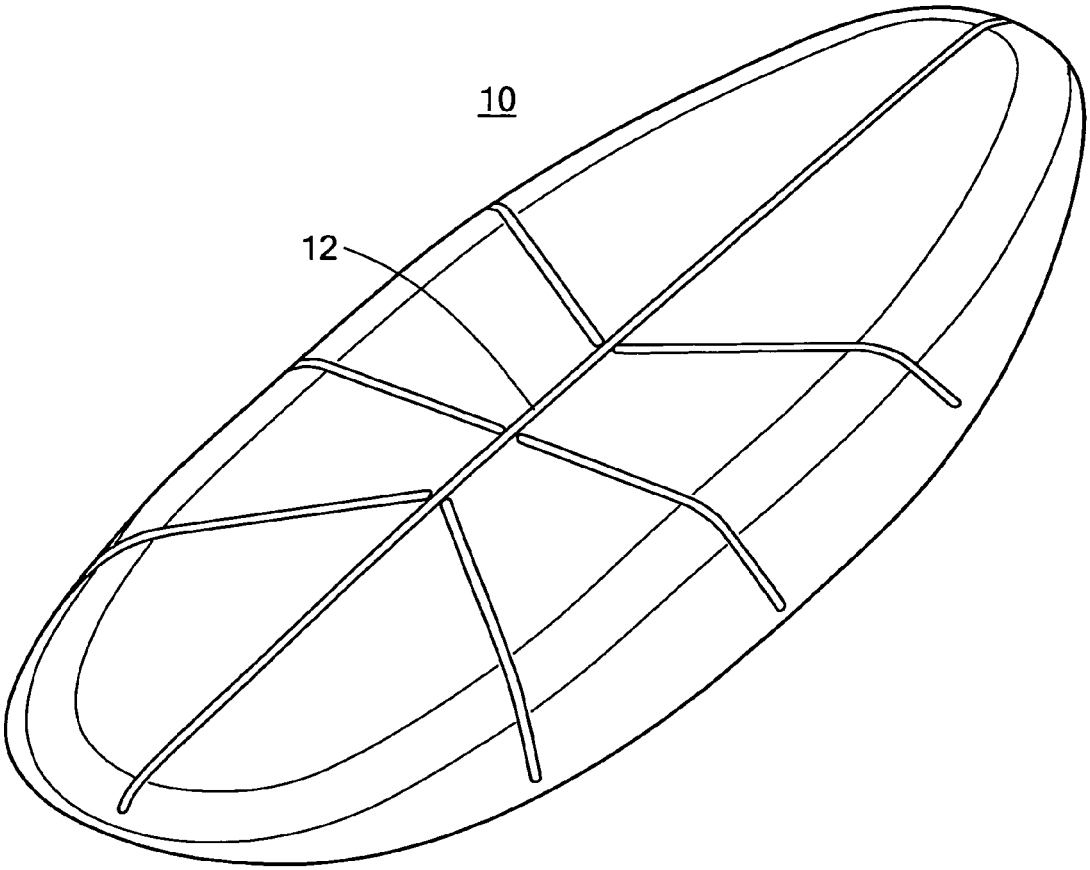
FIG. 1 is a three dimensional view of a high angle, multi-band, broadband sandwich radome to which this invention may be applied.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Because of the emerging demand for commercial airborne broadband communications links (e-mail, TV, etc.) that utilize millimeter wave frequencies (20, 30 and 45 GHz) assigned to satellites, the need for radomes with broadband and multi-band performance has also emerged. The 4-layer wall radome design of this invention provides a unique combination of transmission performance and wall thickness sufficient for strength and stiffness to meet those needs.

The 4-layer wall design for the broadband, multi-band wave radome is an improvement over the previous 3-layer design such as shown in U.S. Pat. No. 7,420,523 B1 incorporated herein in its entirety by this reference. One important application of this 4-layer radome design will be for microwave and millimeter wave multi-band, broadband airborne satellite communication links. The radome is mounted on top of an aircraft fuselage. Its profile is kept as low as possible to minimally affect the aircraft performance. The height may vary from a minimum of approximately nine inches to a maximum of approximately 24 inches in dependence on the sizes and numbers of antennas it must cover. The shape is sometimes a flattened shell, sometimes a tear drop, or an elongated dome or a combination of those whose length varies from approximately six to ten feet and whose width varies from approximately four to five feet. No matter the particular shape, airborne radomes require high incident angle transmission that approaches and even exceeds 70° from normal.

Figure 2:
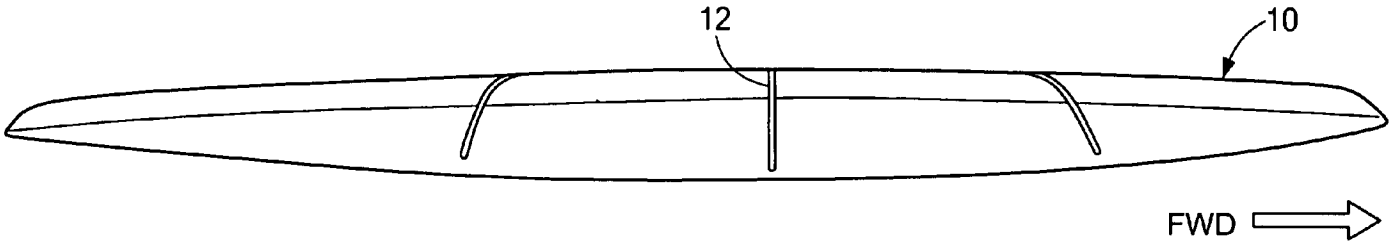
FIG. 2 is a side sectional view of the radome of FIG. 1.
Figure 3:
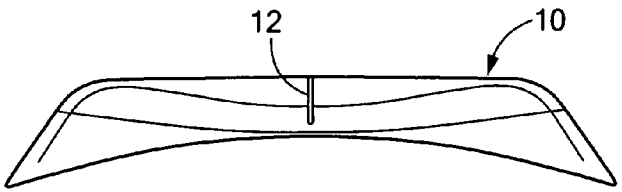
FIG. 3 is an end elevational view of the radome of FIG. 1.
Figure 4:
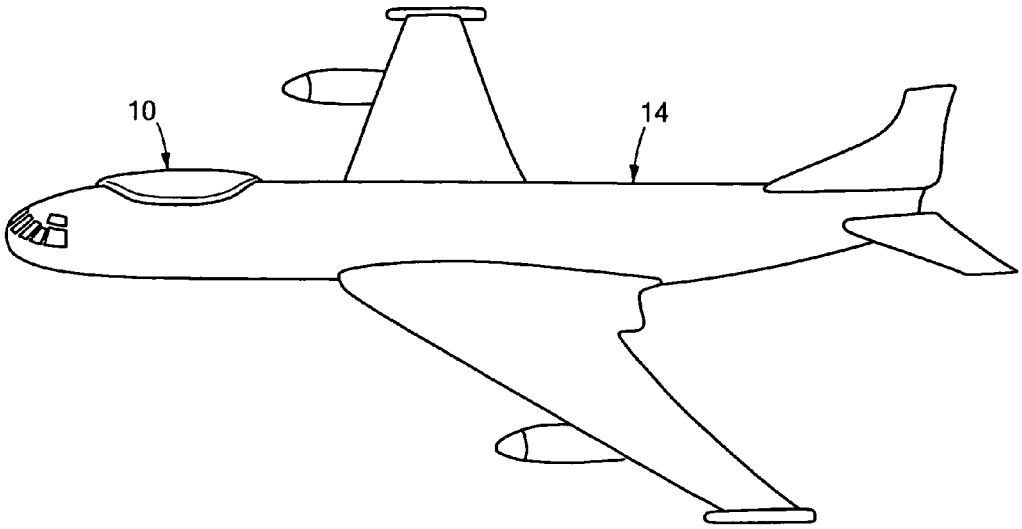
FIG. 4 is a diagrammatic view of the radome of FIG. 1 mounted on an airplane.

One particular shape of the radome 10, FIG. 1, according to this invention has the shape of a rounded tear drop flattened on top. The spider like conductor network 12 is a lightening diversion device and forms no part of the invention. The shape of radome 10 can better be visualized by viewing FIG. 1 in combination with FIG. 2 and FIG. 3, where FIG. 2 is a side view and FIG. 3 is an end view. A typical installation of radome 10 on an airplane 14 is shown in FIG. 4.

Figure 5:
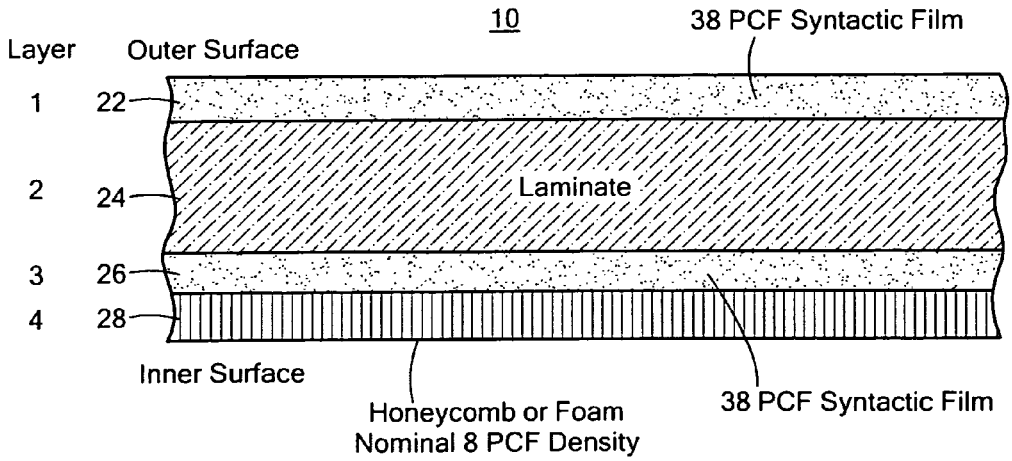
FIG. 5 is a schematic cross sectional view of the layered sandwich radome structure according to one embodiment of the invention.

A cross section diagram of the 4-layer radome wall 10, FIG. 5, according to this invention includes four layers: 1, 2, 3, and 4. Layer 1, 22 is the outside matching layer adjacent to one side of the second layer or structural or laminate layer 24. The 3$^{rd}$ layer is the inside matching layer 26 adjacent to the other side of the structural or laminate layer 24. And the 4$^{th}$ layer, 28, (the inner transmission enhancing layer) is the second inside matching layer for increasing the broadband microwave and millimeter wave frequency transparency. Structural layer 24 as indicated is a laminate. The first inside and the outside matching surfaces 26 and 22, respectively, are typically syntactic film with a nominal density of somewhere from 30 to 45 pounds per cubic foot (PCF), typically 38 PCF, and a relative permittivity between 1.6 and 2.2, for example, near 1.8. With the fourth layer being a low density material with a relative permittivity of 1.05 to 1.25 e.g. near 1.2, these layers function entirely to improve the microwave and millimeter wave transmission. The fourth layer, the second inside matching layer 28, can use one of a number of cellular, foam, fibrous or aerogel materials. Structural layer or laminate 24 has two functions: strength and transparency. Its thickness must be adjusted for transparency and also must be sufficient for the structural loads imposed on it by the external environment. It has a relatively high relative permittivity of approximately 2.5 to 4.5 depending on the material, which limits the transparency, that is, the transmission of the radome for microwave and millimeter wave frequency electromagnetic waves. A fuller explanation of the material and construction of the structural or laminate layer is set forth in U.S. Pat. No. 7,420,523 B1 which is incorporated herein in its entirety by this reference. The outside matching layer 1, 22 and the first inside matching layer 26 are typically made of a syntactic film. They are a mixture of polymer resin and low density glass bubbles whose moderate relative permittivity varies from 1.6 to 2.2 and typically is approximately 1.8; they function to improve the transparency of the radome. The second inside matching layer 4, 28 has an even lower relative permittivity between 1.05 and 1.25 typically around 1.2 that provides additional improvement of the transparency. A description of these materials is listed Table 1. Their densities, in particular that of the structural layer or laminate layer 2, 24, are important because the layer thicknesses required for transparency can cause the weight to become significant. The density and the relative permittivity values have the same trend but are not exactly proportional.

TABLE 1

List of Materials
4-Layer Wall

| Layer | Density - PCF | Permittivity | Description |
|---|---|---|---|
| 1, 3 (22, 26) | 30 to 45 | 1.6 to 2.2 | Syntactic film |
| 2 (24) | 60 to 120 | 2.5 to 4.5 | Laminate: cyanate ester or epoxy resin, with HMPP, quartz, or E-glass |
| 4 (28) | ~8 | 1.05 to 1.25 | Foam or Honeycomb or Aerogel |

The outer surface or outside matching layer 22 and the first inside matching layer 26 are typically made of a syntactic film whose density is about the lowest it can be achieved with a thermo-set, polymer resin and glass bubbles of sufficient density to withstand the processing and environmental forces. The resin may be an epoxy, a cyanate ester, or some hybrid combination with a nominal density of about 1.2 g/cc and with a permittivity of about 2.7 to 3.2. The glass bubbles have a true particle density from 0.15 g/cc to 0.35 g/cc and a particle size from 15 to 115 microns. The thermo-set resin feature is desirable because it allows the pliant pre-cure syntactic film to conform to the two-dimensional curvature of most radomes during fabrication. After curing, the syntactic film provides acceptable hardness and strength for the outer layer that is backed by the much stronger structural layer or laminate 24. Its relative permittivity is typically very near the ideal value of approximately 1.8 in order to improve the transparency of, for example, a quartz laminate with a relative permittivity of 3.25.

The laminate layer 2, or structural layer 24, is the component which provides the stiffness and the strength to the radome. Electrical transparency requirements sometimes force its thickness to exceed that required for adequate stiffness and strength. Because it is the most dense material of the 4-layer design according to this invention, it dominates the weight. The radome laminate may typically be made of a mixture of either epoxy or cyanate ester resin combined with a reinforcing fabric. A more expensive low relative permittivity quartz fabric reinforcement ($E_r$=3.78) may replace the high relative permittivity E-glass fabric ($E_r$=6.13) to achieve acceptable radome transparency. For either quartz or E-glass fabric the thickness of the radome wall and in particular the laminate thickness results in a high areal weight value in the range of approximately 2 to 3 pounds per square foot. Another reinforcing fabric which may be used in the 4-layer construction of this invention is either high modulus polypropylene (HMPP) or a combination of HMPP fiber and E-glass fiber. HMPP either entirely or in part reduces weight because it is very low density (54 PCF) compared to about 137 PCF for quartz and 162 PCF for E-glass. HMPP has improved transparency because of its low permittivity ($E_r$=2.0) and low cost; it is even less expensive than E-glass fabric.

Layer 4, the inner transmission enhancing layer 26, presents the most difficulty because low relative permittivity is available only in a limited number of materials that have the properties required for: curved surface processing at the necessary 250° F. to 350° F., for dimensional consistency, and for millimeter wave transparency. In particular, room temperature formability to compound curvature surfaces, sufficient service temperature for the curing process, millimeter wave frequency transparency, and low cost are important criteria. Four different materials are proposed herein for layer 4, 28: honeycomb, rigid polymeric foam, E-Glass or quartz fiber mat, and aerogel. All should have a relative permittivity near 1.2 to function properly in this design.

With regard to honeycomb the properties of HRP glass fabric reinforced honeycomb styles that are available from the manufacturer HEXCEL are shown in Table 2. The cell type—hexagonal, OX-Core, and Flex-Core—affect the flexibility of the honeycomb. Near the 8 PCF density value required for layer 4, 28 these honeycomb materials have flexibility in 0, 1 and 2 planes. Sufficiently small cell size is crucial in order to avoid spurious resonances and excess attenuation when a half-wavelength becomes less than the cell size. By this criterion, 3/16" hexagonal and F50 Flex-Core appear adequate for 30 GHz, but not 45 GHz; the minimum ¼" cell size for the OX-Core appears marginal even for 30 GHz. The available densities provide acceptable approximations of the nominal design permittivity value required for the second inside matching layer.

TABLE 2

HRP Honeycomb Selected Properties
Approximate 0.2" Cell Size
Density Most Nearly Approximating 1.15 Relative Permittivity

| Cell Type | Designation | Note | Er'(0°) | tand (0°) |
|---|---|---|---|---|
| Hexagonal | HRP-3/16-8 | (1) | 1.17 | 0.0052 |
| OX-Core | HRP/OX-¼-7 | (2) | 1.15 | 0.0047 |
| Flex-Core | HRP/F50-5.5 | (3) | 1.10 | 0.0035 |

Notes
(1) For an 8 PCF density, standard hexagonal cell honeycomb is quite rigid - similar to a wooden board. The 3/16" cell size is adequate for frequencies up to about 35 GHz, but not up to 45 GHz.
(2) OX-Core is flexible in one dimension, but the minimum available ¼" cell size may be marginal even for 31 GHz.
(3) The minimum cell size for Flex-Core (50 per foot) may be adequate for 31 GHz, but the maximum 5.5 PCF density available for this style cell limits the permittivity to 1.10.

With regards to the use of a polymeric foam for layer 4, 28 a number of products are available among them being Rohacell and Divinycell. Both products are manufactured as sheet stock that is rigid at room temperature. Heating with pressure and a forming tool is required to generate a curved shape as would be required for the layer 4, inner transmission and enhancing layer 28, material. Rohacell has a high service temperature that allows it to be cured with the highest performance 350° F. laminate. Divinycell versions have a lower service temperature. Both foams are available in densities from 3 to 12 PCF, with a version near 8 PCF. Although the structural and the microwave to millimeter wave performance of these materials is acceptable for layer 4, 28, there is a higher processing cost.

With regard to the mat material, E-glass or quartz fibers are randomly oriented and inter-twined, a density near 8 PCF has a permittivity near 1.2. The matting is sometimes held together by loose stitching.

A fourth material for this embodiment of layer 4, 28 is aerogel, for example, Aspen Aerogel which is derived from a gel by replacing its liquid component by a gas. The result is a solid that combines extremely low density with low thermal conductivity. The original silica aerogel was rigid, would shatter under sudden stress as glass does, was remarkably strong for static loads, had a high service temperature, and was an astonishing insulator. Aspen Aerogel is a combination of silica aerogel with reinforcing fibers that makes it flexible in one dimension, yet retains a permittivity value near 1.2 and an operating temperature that makes it suitable to fabricate radomes with a $2^{nd}$ inside matching layer. For this application, Aspen Aerogel is a particular implementation of a flexible material for the $2^{nd}$ inside matching layer that is commercially available as sheet material with a thickness of 3 mm to 6 mm. The material has sufficient spring-back (resilience) to recover its original thickness after being compressed during fabrication; its compression is about 15 percent for a pressure of 15 psi. The material repels liquid water, but allows water vapor to pass.

The 4-layer radome wall design according to this invention is important to achieve a transmission efficiency of at least 70% that is common to the multiple frequency bands that are available for airborne, commercial and military satellite communication links for example. In particular, designs for several types of multi-band applications are of interest. Application A involves ~13 GHz for Ku-band, ~20 GHz for K-band, and ~30 GHz for Ka-band; another application B involves ~20 GHz for K-band, ~30 GHz for Ka-band, and ~45 GHz for Q-band. The total thickness of the radome wall (0.4" to 0.7") and the individual layer thickness values depend on the frequencies for which transparency is required.

The thicknesses of the radome wall and the individual layers are shown for the different materials of layer 1, structural layer 24, and layer 4, inner transparency enhancing layer 28, inside matching layer 3, layer 26, and outside matching layer 1, layer 22 in Table 3.

TABLE 3

4-Layer Radome Wall Layers
Material and Nominal Thickness Summary

| Layer: Function | FIG. 5 Layer Designation | Material | Thickness - Inches (1) Application A | Thickness - Inches (1) Application B |
|---|---|---|---|---|
| 2: Structural | 24 | HMPP Laminate | 0.20 | 0.15 |
| | | Quartz Laminate | 0.15 | 0.15 |
| | | E-Glass Laminate | 0.20 | 0.15 |
| 3: Inside $1^{st}$ Match | 26 | Syntactic Film | 0.1 | 0.06 |
| 1: Outer Match | 22 | Syntactic Film | 0.1 | 0.06 |
| 4: Inside $2^{nd}$ Match | 28 | Honeycomb Polymer Foam Fiber Mat Flexible Aerogel | 0.25 | 0.13 |

Note
(1) Exact thickness depends on the precise frequency specification and on the precise permittivity value for the particular material.

The material composition of the layers need not change either for Application A or Application B. The layer thickness for these applications may vary according to the nominal value listing of Table 3 in order to accommodate the differing frequency requirements.

The anticipated demand for broadband military and commercial airborne applications requires an expansion of the communication links for joint operation at Ku-band (approximately 11 to 15 GHz) and millimeter wave frequencies (approximately 20, 30, and 45 GHz). The flattened, streamlined shapes of the radomes required for those links imposes high incidence angles in the forward and aft directions at low elevation angles. The four layer sandwich radome of this invention meets those demands.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A multi-band, broadband, high angle, sandwich radome structure comprising:

a structural layer;

a first inside matching layer adjacent to one side of the structural layer;

an outside matching layer adjacent to the other side of the structural layer; and a second inside matching layer for increasing broadband microwave and millimeter wave frequency transparency.

2. The radome structure of claim 1 in which said second inside matching layer includes a low density medium.

3. The radome structure of claim 2 in which said low density medium includes an aerogel material.

4. The radome structure of claim 2 in which said low density material includes a polymer foam.

5. The radome structure of claim 2 in which said low density material includes an E-Glass or a quartz fiber matting.

6. The radome structure of claim 2 in which said low density medium includes a honeycomb material.

7. The radome structure of claim 2 in which said second inside matching layer has a density of approximately eight pounds per cubic foot.

8. The radome structure of claim 2 in which said second inside matching layer has a permittivity between 1.05 and 1.25 inclusive.

9. The radome structure of claim 1 in which said structural layer is a laminate.

10. The radome structure of claim 1 in which said structural layer includes at least one of epoxy and cyanate ester resin combined with a reinforcing fabric.

11. The radome structure of claim 10 in which said reinforcing fabric is at least one of low relative permittivity quartz fabric, high permittivity E-glass fabric, and high modulus polypropylene (HMPP).

12. The radome structure of claim 1 in which said structural layer has a density of 60-120 pounds per cubic foot.

13. The radome structure of claim 1 in which said structural layer has a permittivity of 2.5-4.5.

14. The radome structure of claim 1 in which said first inside and said outside matching layers include a syntactic film.

15. The radome structure of claim 14 in which said syntactic film has a density of 30-45 pounds per cubic foot.

16. The radome structure of claim 14 in which said syntactic film has a permittivity of 1.6 to 2.2.

17. A multi-band, broadband, high angle, sandwich radome structure comprising:

a laminate structural layer;

a first inside matching syntactic layer adjacent to one side of the structural layer;

an outside matching layer adjacent to the other side of the structural layer; and a second inside matching layer for increasing broadband microwave and millimeter wave transparency.

18. The radome structure of claim 17 in which said second inside matching layer includes a foam material.

19. The radome structure of claim 18 in which said foam material includes a polymer foam.

20. The radome structure of claim 17 in which said second inside matching layer includes an aerogel material.

21. The radome structure of claim 17 in which said second inside matching layer includes an E-Glass or a quartz fiber matting.

22. The radome structure of claim 17 in which said second inside matching layer includes a honeycomb material.

23. A multi-band, broadband, high angle, sandwich radome structure comprising:

a laminate structural layer;

a first inside matching syntactic layer is adjacent to one side of the structural layer;

an outside matching syntactic layer adjacent to the other side of the structural layer; and a second inside matching aerogel layer for increasing broadband and microwave and millimeter wave frequency transparency.

24. The radome structure of claim 23 in which said second inside matching layer includes a foam material.

25. The radome structure of claim 24 in which said foam material includes a polymer foam.

26. The radome structure of claim 23 in which said second inside matching layer includes an aerogel material.

27. The radome structure of claim 23 in which said second inside matching layer includes an E-Glass or a quartz fiber matting.

* * * * *